United States Patent [19]

Hendrickson

[11] Patent Number: 4,936,241

[45] Date of Patent: Jun. 26, 1990

[54] COOLER ASSEMBLY FOR CATAMARANS

[76] Inventor: James P. Hendrickson, 601 Appomattox Dr., Warrenton, Va. 22186

[21] Appl. No.: 381,476

[22] Filed: Jul. 18, 1989

[51] Int. Cl.[5] ..... B63B 17/00

[52] U.S. Cl. ..... 114/343; 114/364; 114/61; 248/311.2

[58] Field of Search ..... 114/343, 364, 270, 61, 114/39.1, 39.2; 248/228, 311.2; 108/44; 224/324–329, 309

[56] References Cited

U.S. PATENT DOCUMENTS

| | | | |
|---|---|---|---|
| 2,387,779 | 10/1945 | Strauss | 224/329 |
| 2,574,018 | 11/1951 | Cotton | 224/329 |
| 4,020,986 | 5/1977 | McAfee | 62/371 |
| 4,050,264 | 9/1977 | Tanaka | 62/457.2 |
| 4,281,520 | 8/1981 | Norwood | 62/372 |
| 4,398,488 | 8/1983 | Mathieu | 114/343 |
| 4,449,378 | 5/1984 | Thorpe | 224/307 |
| 4,545,722 | 10/1985 | Stockhausen | 441/74 |

*Primary Examiner*—Joseph F. Peters, Jr.
*Assistant Examiner*—Edwin L. Swinehart
*Attorney, Agent, or Firm*—Leon Gilden

[57] ABSTRACT

A cooler assembly for particular use in combination with catamarans is set forth comprising a support base defined as a container formed with planar sides and a planar floor overlying an arcuate bottom surface of a complementary configuration to a convex arcuate upper surface of a pontoon of an associated catamaran. The container includes a plurality of clips secured to each side of the container to secure the container to downwardly directed flanges of the catamarans pontoon. A flexible strap is pivotally mounted at one end to a right side of the container and formed with a forward terminal end including a rigid "U" shaped clip for reception within a slot formed within a left wall of the container to secure an associated refrigerant cooler within the confines of the container.

10 Claims, 1 Drawing Sheet

Fig 1
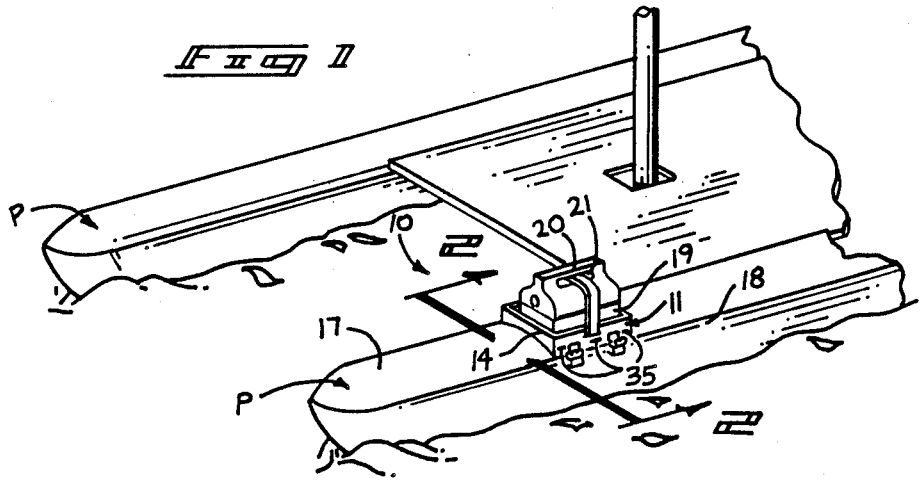
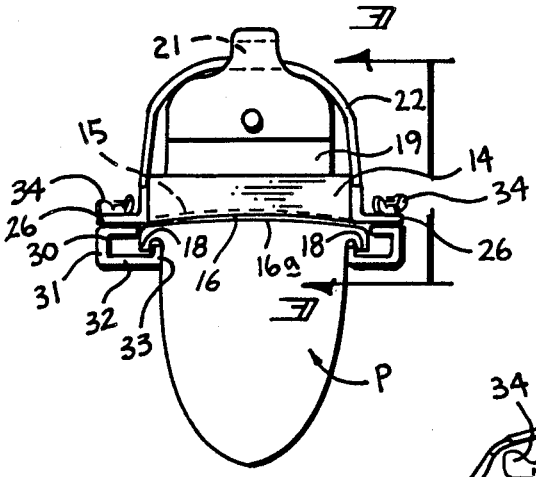
Fig 2
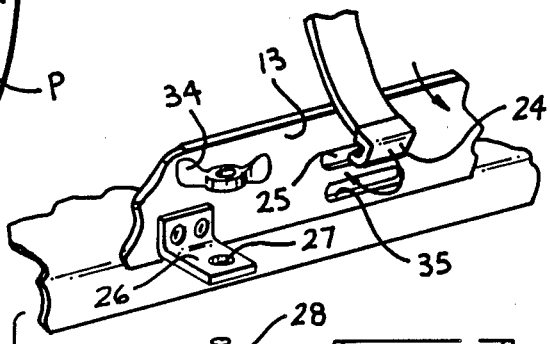
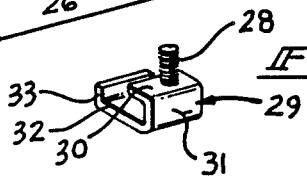
Fig 3
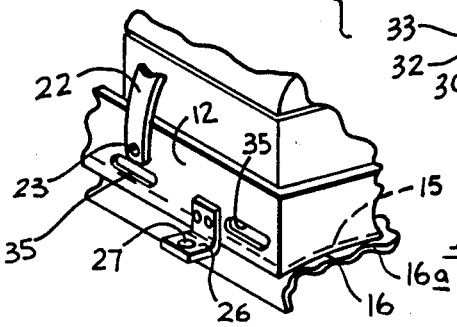
Fig 4

COOLER ASSEMBLY FOR CATAMARANS

BACKGROUND OF THE INVENTION

1. Field of the Invention

The field of invention relates to cooler assemblies, and more particularly pertains to a new and improved cooler assembly for catamarans that enables an associated refrigerant cooler to be selectively maintained relative to an upper surface of the catamarans pontoon.

2. Description of the Prior Art

Cooler assemblies of various configuations and organizations have been utilized in the prior art to accommodate particular needs. Heretofore, however, the prior art has failed to provide a refrigerant cooler assebly that is readily secured and removed relative to a catamaran to enable selective access to items stored within the refrigerant cooler. Examples of prior art devices that have heretofore been developed may be found in U.S. Pat. No. 4,050,264 to Tanka for example. An insulated bag-like container is provided with a pivoted lid to encompass food materials and the like contained therewithin with an inner lid pressed down to contact food contents within the container to minimize a space between the inner lid and the contents to increase cooling of such contents.

U.S. Pat. No. 4,020,986 to McAtee sets forth a portable storage assembly for securing items within a vehicle that includes storage space at ambient and refrigerated temperatures, dependent upon the items to be secured. The patent is of interest relative to the application of a container for use in a vehicle, but is of a relatively remote organization to that of the instant invention.

U.S. Pat. No. 4,281,520 to Norwood sets forth a plurality of hollow modules, each containing a liquid refrigerent to maintain a bottle with an elongate neck therewithin and enable cooling of the bottle and effect portability of the organization.

U.S. Pat. No. 4,449,378 to Thorpe sets forth an insulated chest for transport as a backpack by an individual including a plurality of storage compartments, as well as a fluid dispenser and is of interest relative to the directed portability of the device.

As such, it may be appriciated that there is a continuing need for a new and improved cooler assembly for particular use in combination with catamarans to enable selective securement of refrigerant coolers onto the catamarans, and particularly addresses the problems of maintaining rigid securement of the cooler assembly in the turbulent environment typically encountered in the use of a catamaran and in this respect, the present invention substantially fulfills this need.

SUMMARY OF THE INVENTION

In view of the foregoing disadvantages inherent in the known types of cooler assemblies now present in the prior art, the present invention provides a cooler assembly for catamarans wherein the same may be selectively secured to an upper arcuate surface of a catamaran pontoon to enable selective containment of a refrigerant cooler therein during periods of use. As such, the general purpose of the present invention, which will be described subsequently in greater detail, is to provide a new and improved cooler assembly for catamarans which has all the advantages of the prior art cooler assemblies and none of the disadvantages.

To attain this, the cooler assembly for catamarans comprises a container formed with planar side and forward walls including a planar floor for receiving a refrigerant cooler thereon. The bottom surface of the container is of a concave configuration for more complementarily receiving a convex upper surface of a pontoon associated with a catamaran. A plurality of spaced clips on each side wall engage downwardly depending flanges of the pontoon for securement of the container to the pontoon. A flexible strap is directed through a handle aperture within the refrigerant cooler wherein the strap is pivotally mounted at one end and formed with a rigid "U" clip at its other end for reception within an elongate solt formed within an opposing wall.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved cooler assembly for catamarans which has all the advantages of the prior art cooler assemblies and none of the disadvantages.

It is another object of the present invention to provide a new and improved cooler assembly for catamarans which may be easily and efficiently manufactured and marketed.

It is a further object of the present invention to provide a new and improved cooler assembly for catamarans which is of a durable and reliable construction.

An even further object of the present invention is to provide a new and improved cooler assembly for catamarans which is susceptible of a low cost of manufacture with regard to both materials and labor, and which accordingly is then susceptible of low prices of sale to the consuming public, thereby making such cooler assemblies for catamarans economically available to the buying public.

Still yet another object of the present invention is to provide a new and improved cooler assembly for catamarans which provides in the apparatuses and methods of the prior art some of the advantages thereof, while simultaneously overcoming some of the disadvantages normally associated therewith.

Still another object of the present invention is to provide a new and improved cooler assembly for catamarans wherein the same sets forth a container including spaced clips for engagement with downwardly depending flanges formed on an associated pontoon of a catamaran.

These together with other objects of the invention, along with the various features of novelty which characterize the invention, are pointed out with particularity in the claims annexed to and forming a part of this disclosure. For a better understanding of the invention, its operating advantages and the specific objects attained by its used, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of the instant invention in combination with a catamaran.

FIG. 2 is an orthographic view taken along the lines 2—2 of FIG. 1 in the direction indicated by the arrows.

FIG. 3 is an isometric illustration, somewhat expanded, in sectional view of the left side wall of the invention.

FIG. 4 is an isometric view, somewhat expanded, taken in section of the right side wall of the invention.

DESCRIPTION OF THE PREFERRED EMBODIMENT

With reference now to the drawings, and in particular to FIGS. 1 to 4 thereof, a new and improved cooler assembly for catamarans embodying the principles and concepts of the present invention and generally designated by the reference numeral 10 will be described.

More specifically, the cooler assembly for catamarans 10 essentially comprises a support container 11 secured to an upper surface of a single pontoon "P", as illustrated in FIG. 1, of typical catamaran construction. The container 11 is defined by spaced parallel side wall defined by a left side wall 12 and a right side wall 13 that are in turn orthogonally and integrally secured to structurally equivalent parallel forward and rear walls 14. The container 11 is further defined by a planar interior floor 15 to receive a refrigerant coolant container 19 thereon. A bottom surface 16 of the container 11 is defined as an arcuately concave bottom surface 16 to complementarily receive a top pontoon surface 17 of the pontoon "P". As illustrated in FIG. 2 for example, the pontoon "P" is formed with spaced parallel pontoon flanges directed downwardly of the pontoon "P" and positioned coextensive of the pontoon and arranged on either side thereof to define an elongate groove between each pontoon flange 18 and the side walls of the pontoon.

To accommodate the convex arcuate upper surface 17 of the pontoon "P", the forward and rear walls 14 may each alone be formed with an arcuate bottom edge 16*a* to receive to top surface 17 therewithin.

The coolant container 19 is formed with a pivotally mounted lid with a handle 20 integrally formed thereto with a through-extending handle slot 21 defined by the lid and handle 20 of the container 19. A flexible band 22 is directed through the handle slot 21 and is secured to the left side wall 12 of the container by a pivot junction 23 at a first terminal end of the flexible band 22 and is selectively secured to the right side wall 13 by use of a rigid "U" shaped clip 24 formed at a second terminal end of the flexible band 22, wherein the clip 24 is receivable within an elongate wall slot 25 formed medially of the right side wall 13. Each side wall 12 and 13 includes a plurality of "L"shaped brackets 26 with a vertical leg integrally secured to a respective side wall with each horizontal leg of each "L" shaped bracket 26 including a through-extending aperture 27 orthogonally directed proximate a terminal end of the horizontal leg of each "L" shaped bracket. The apertures 27 are oriented and arranged to receive a threaded stud 28 securable with a nut member 34 orthogonally and integrally formed to a pontoon clip 29. Each pontoon clip 29 is received within the aforenoted groove defined between the pontoon flanges 18 and the side walls of the pontoons "P". The pontoon clip 29 is formed with a top horizontal leg of a first length integrally and orthogonally formed to a rear vertical connecting web 31 that is integrally formed to a bottom horizontal leg 32 of a second length, wherein the second length is of a distance greater than the first length and terminates in a forward flange 33 received within the aforenoted groove of the pontoon "P". In this manner, the support container 11 may be secured as desired about the upper surface of the pontoon "P". Reference to FIGS. 1, 3, and 4 note the use of a series of elongate drain slots 35 formed through the side walls 12 and 13 coextensively therewith to enable drainage of fluid received within the container 11. It has been determined that three equally spaced slots 35 directed through each side wall adjacent the floor 15 are sufficient to effect efficient drainage interiorly of the container 11.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principiles of the invention. Furhter, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A cooler assembly for catamarans wherein a catamaran includes at least one pontoon including a convex upper surface and spaced grooves defined between downwardly directed flanges formed adjacent each side surface of the pontoon adjacent the upper surface and wherein the cooler assembly comprises, a container including a right side wall spaced from a left side wall, a forward wall spaced from a rear wall including a planar interconnecting floor to define an interior of the container, and the floor overlying an arcuate concave bottom surface to receive the convex upper surface of the pontoon therein, and a plurality of clip means secured to the side walls of the container for securement of the container to the pontoon, and a cooler container received within the interior of the container, and strap means for securement of the cooler container to the container.

2. A cooler assembly for catamarans as set forth in claim 1 wherein the concave bottom surface includes a concave bottom edge formed in the forward wall and the rear wall of the container.

3. A cooler assembly for catamarans as set forth in claim 2 wherein the concave bottom surface further includes a coextensive concave surface formed between the arcuate bottom edge of the forward and rear walls.

4. A cooler assembly for catamarans as set forth in claim 3 wherein each clip means includes as "L" shaped bracket wherein the "L" shaped bracket includes a vertical leg integrally secured to a side wall of the container with a horizontal leg extending outwardly of each side wall and including a through-extending aperture therethrough.

5. A cooler assembly for catamarans as set forth in claim 4 wherein the clip means further includes a pontoon clip formed with a vertically arranged threaded stud member receivable through the aperture, and wherein the stud member is integrally secured to a top horizontal leg that includes a free end and a further end integrally formed to a vertical connecting web, and the connecting web is integrally formed at its bottom extent to a bottom horizontal leg wherein the bottom horizontal leg is of a length greater than that of the top horizontal leg, and the bottom horizontal leg terminates in an upwardly directed forward flange receivable within the groove formed in the pontoon.

6. A cooler assembly for catamarans as set forth in claim 5 further including a threaded securement nut for securing each pontoon clip to each "L" shaped bracket.

7. A cooler assembly for catamarans as set forth in claim 6 wherein a plurality of "L" shaped brackets are secured to each side wall of the container and each "L" shaped bracket includes a pontoon clip operatively associated therewith.

8. A cooler assembly for catamarans as set forth in claim 7 wherein the strap means includes a first end pivotally mounted medially of the left side wall, and wherein the strap means further includes a further end formed with a rigid "U" shaped clip integrally secured thereto, and the right side wall includes an elongate slot for selectively receiving the "U" shaped clip.

9. A cooler assembly for catamarans as set forth in claim 8 wherein the cooler container includes a handle defining an enclosed handle slot for receiving the strap means therethrough.

10. A cooler assembly for catamarans as set forth in claim 9 further including a series of elongate slots directed through each side wall adjacent to and overlying the floor to effect drainage of fluid interiorly of the container.

* * * * *